United States Patent [19]

Young

[11] Patent Number: 4,476,392

[45] Date of Patent: Oct. 9, 1984

[54] PHOTOELECTRON SOURCE FOR USE IN A GAS CHROMATOGRAPH DETECTOR AND MASS SPECTROMETER ION SOURCE

[76] Inventor: Robert A. Young, 9773 Variel Ave., Chatsworth, Calif. 91311

[21] Appl. No.: 334,489

[22] Filed: Dec. 28, 1981

[51] Int. Cl.[3] ..... H01J 27/20; H01J 27/24; H01J 49/10; H01J 49/14

[52] U.S. Cl. ..... 250/423 R; 250/423 P; 250/427; 250/288

[58] Field of Search ..... 250/423, 423 P, 424, 250/427, 288

[56] References Cited

U.S. PATENT DOCUMENTS 3,902,064 8/1975 Young ..... 250/423 X 4,377,749 3/1983 Young ..... 250/423 P

*Primary Examiner*—Alfred E. Smith

*Assistant Examiner*—Jack I. Berman

*Attorney, Agent, or Firm*—John E. Benoit

[57] ABSTRACT

An ionization source is disclosed for use with mass spectrometers and electron capture species detectors having an ionization light source excited so as to illuminate a fluid sample which flows past the light source whereby electrons are photoelectrically generated by a light source. Means are also provided to accelerate the photoelectrons and to extract heavy ions generated by the accelerated photoelectrons from the fluid sample. Further means are provided to focus the extracted heavy ions so that they may be detected. Also included is a means to maintain a vacuum between the light source and the sample and the detector.

32 Claims, 5 Drawing Figures

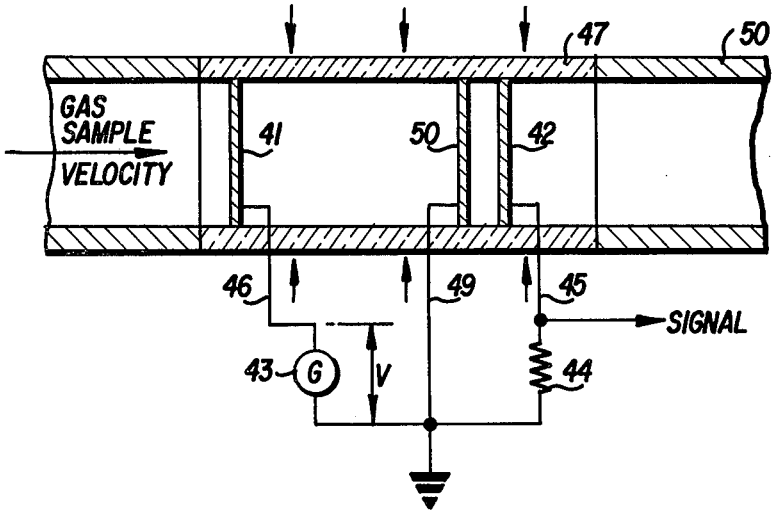
FIG. 3a
FIG. 3b
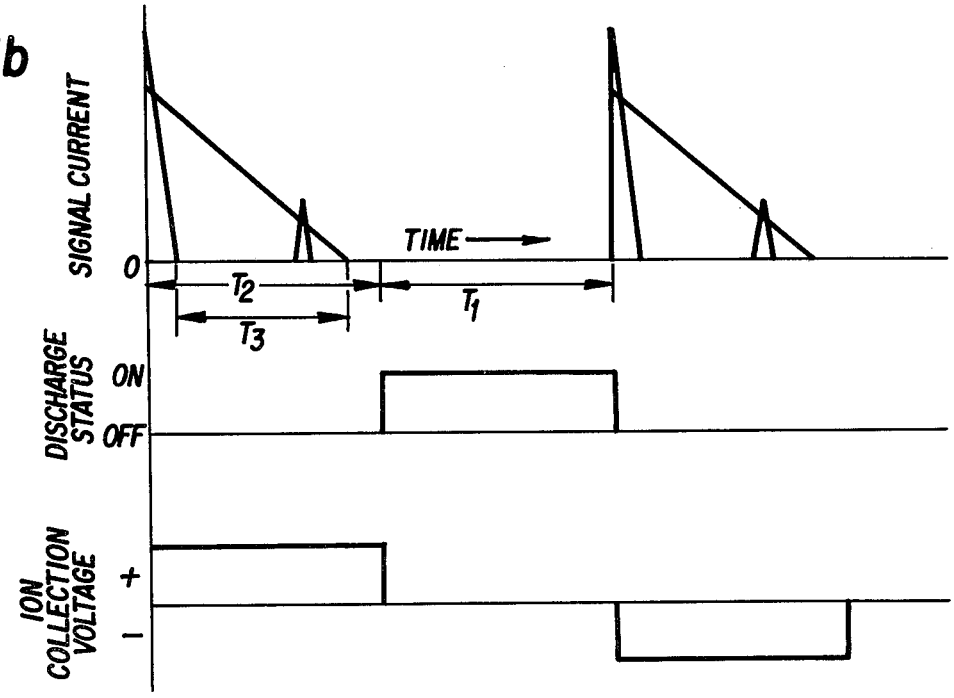
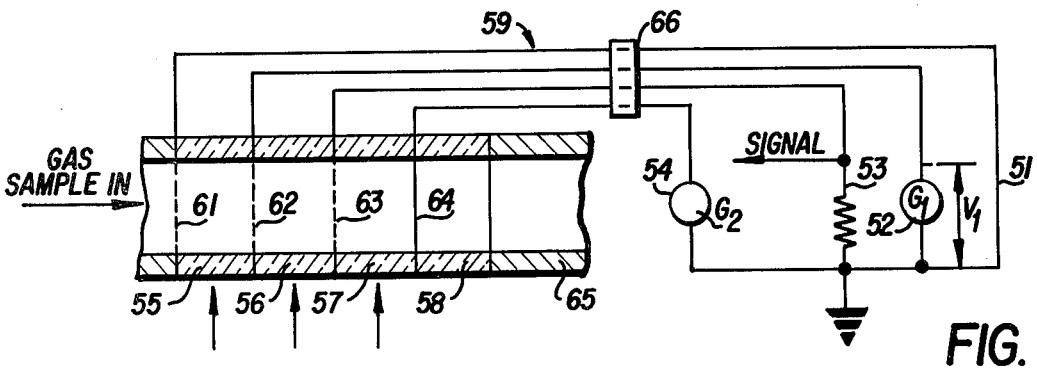
FIG. 3c

PHOTOELECTRON SOURCE FOR USE IN A GAS CHROMATOGRAPH DETECTOR AND MASS SPECTROMETER ION SOURCE

This application relates generally to a photoelectric electron source for mass spectrometer ionization source and for an electron capture chromatograph detector.

BACKGROUND OF THE INVENTION

This patent is a modification of the photoionizer described in U.S. Pat. No. 4,377,749 filed Feb. 25, 1981 in the name of the present inventor. The modification relates to the electrode structure which now includes a non-reactive, stable, photocathode from which electrons are ejected by photons, and these electrons are further utilized. At high sample gas pressure, the electrons form negative ions by attachment to constituents of the sample and these are later measured. This constitutes an electron capture detector in chromatography. At low sample pressure, the electrons form the photocathode are accelerated to ionization energies ($\approx$100 ev) and used to ionize a low pressure sample gas, and these ions are analyzed in a mass spectrometer.

LOW SAMPLE PRESSURE OPERATION

Mass spectrometers separate ions of different charge/mass (e/m) ratios and measure the flux of each. Hence, the species to be measured (which is uncharged) must be ionized. This is usually accomplished by an electron beam of approximately 100 electron volts energy. The electrons are produced from a heated filament and accelerated to the required energy by an electric field.

A heated filament has disadvantages, such as limited life, susceptibility to oxidation if a proper vacuum is not present, thermal decomposition of some of the sample gas to be measured, and an increase in the energy spread of the electron beam.

Cold cathode electron sources exist but, because they depend upon large electric fields at the cathode's surface, they have many practical disadvantages associated with providing this high field.

The present invention uses high energy photons and a high work function photocathode (such as gold, platinum, or other metals) as the source of electrons from which to form an electron beam for ionization of gases by electrical impact. Because of this, the deficiencies of other electron sources are overcome.

The photoelectric effect has been known for many years, but only recently with the invention of small, efficient, sources of high energy photons such as described in U.S. Pat. Nos. 4,002,922, 3,841,214, 3,904,907, 3,946,272 and 4,002,432, has it been practical to produce a sufficiently intense source of electrons by this means to form an electron beam that would be suitable as an ionization and excitation source in analytical instruments such as mass spectrometers and optical spectrometers.

BRIEF DESCRIPTION OF THE DRAWINGS

FIGS. 3*a* through 3*c* are schematic and graphical illustrations used for further explanation of the invention.

DETAILED DESCRIPTION OF THE INVENTION

Figure 1:
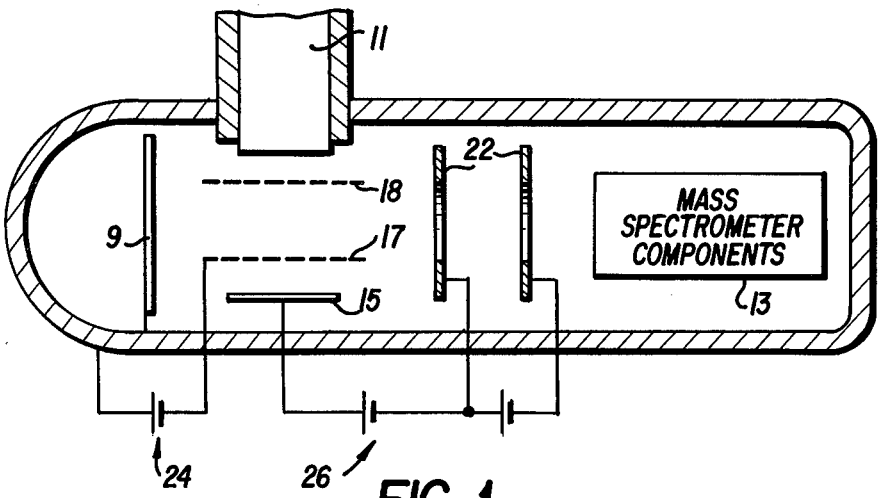
FIG. 1 PRIOR ART
FIG. 1 is a schematic illustration of the prior art employing VUV as a mass spectrometer ionization source.

FIG. 1 shows a typical prior art application employing usual VUV light sources 11 as a mass spectrometer ionization source which illuminate photocathode 15. The electrons ejected from the electrode are accelerated by the field between photocathode 15 and acceleration grid 17. In the almost field free region between acceleration grid 17 and anode grid 18, the electrons ionize the gas present, and these ions are drawn out by electron lenses 22 and into the mass spectrometer 13 which separates the ions into separate e/m images where the ions are collected and their number measured. The energy of the electron beam is determined by the potential between photocathode 15 and acceleration grid 17. There is a field between the lamp and its housing, and the anode grid 18 which slows the electrons so that they are collected on the anode grid. Potential sources 26 and 24 establish the required electric fields.

The ions in the draw-out region between grids 17 and 18 are formed by both photoionization and by electron impact ionization. However, since the electrons may have much more energy than the photons which eject them from photocathode 15, more species may be ionized in larger quantities by the electrons, while less fragmentation will occur with photoionization than with electron ionization. Hence, it may be desirable to suppress electron ionization processes to simplify the e/m spectra. This is easily done by reducing and reversing the sign of the potential source 26 so that the photoelectrons are driven back to the photocathode and do not reach the ionization region.

Figure 2:
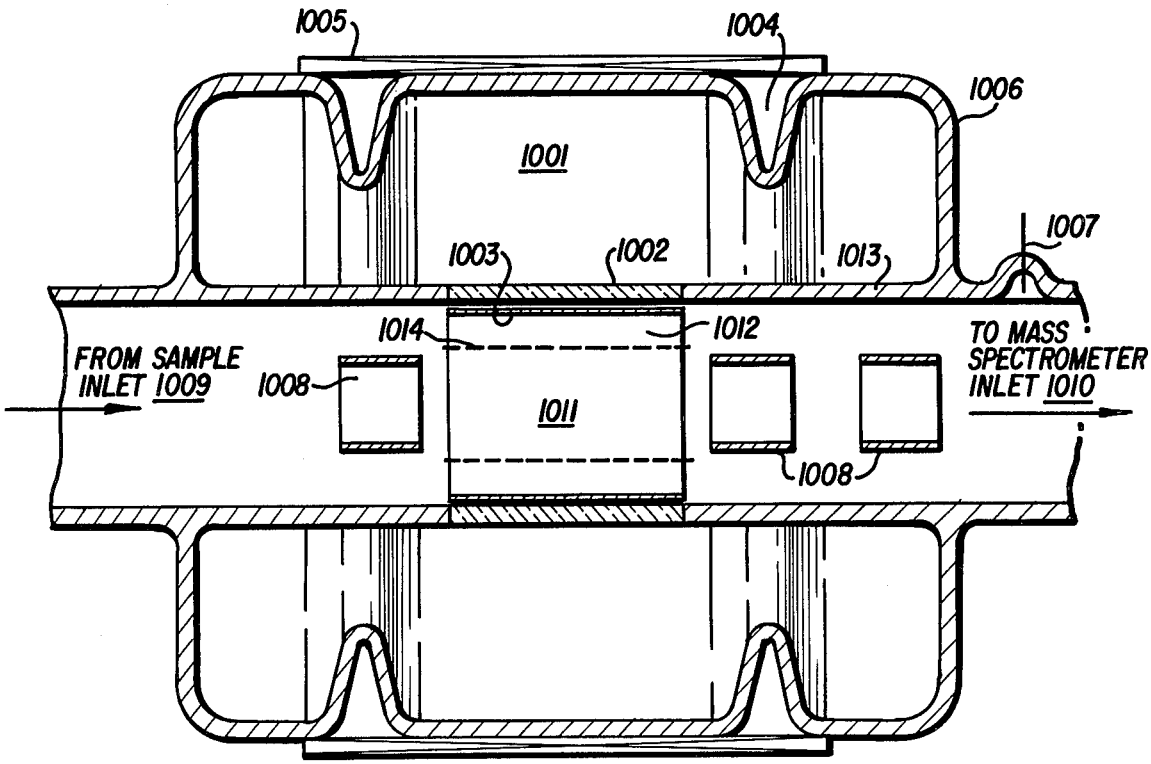
FIG. 2 is a schematic illustration of the present invention as an improvement over the prior art.

The present invention improves on this arrangement by employing the "Surround $4\pi$" geometry of U.S. Pat. No. 4,377,749, filed Feb. 25, 1981 in the name of the present inventor, as shown in FIG. 2. In this embodiment, the device is cylindrically symmetric with an RF oscillator coil 1005 outermost from the axis and supporting the lamp, the outer lamp wall 1006, with its stress relief bellows 1004, next toward the axis. The RF oscillator coil is driven in a frequency range of 50 to 250 MHz by a driven series resonant circuit which includes coil 1005. Inside this wall is the VUV discharge region 1001 where the optical photons are generated. The light source body is completed with the sample passageway walls, 1013, which contains a cylindrical VUV transparent section 1002, through which the ionizing radiation enters the sample passageway.

Near the cylindrical window 1002 is a photocathode 1003 of a nonreactive conducting material which must be either thin enough for electrons to be ejected from the opposite side from which it is illuminated, or composed of a grid or mesh. An acceleration grid, 1014, is at a positive potential relative to the photocathode, 1003, and so extracts and accelerates the electrons from the photocathode and projects them into the ionization region, 1011, where the electrons ionize the sample gas. The electrons which do not suffer a collision in passing radically through this region, 1011, are decelerated after they pass grid 1014. Some of these electrons will be trapped radically and oscillate through the ionization region many times before being intercepted by grid 1014 or leaving the end of the ionization region at its ends. This will increase the efficiency of ionization by the electrons and is an improvement on earlier designs employing heated filaments because of the cylindrical symmetry of the geometry and equipotential of the photocathode.

The ionization region is free of electric fields except for those created by the electrons present there, fringes of the acceleration field from grid 1014, and the heavy ion draw-out fields created by the ion lenses, 1008.

The ion draw-out lenses, 1008, extract the low energy positive ion from the ionization region, 1011, and focus them into a mass spectrometer which can be either of the magnetic focusing or quadrupole type.

HIGH SAMPLE PRESSURE OPERATION

When the detector is used in the electron attachment mode at higher sample pressures, there are two currents, one due to the electron and one due to heavy negative ions, and these are separated by the different mobility of their carriers. The mobility coefficient, $\mu$, is defined from $v=\mu E$ where $v$ is the velocity of the charge and E is the electric field it is experiencing. The heavier (and larger) the ions the smaller $\mu$ is. Only when many collisions occur during transit from source to detector does an average $v$ occur which follows this equation and only when $v$ is smaller than the thermal velocity of the gas molecules is this equation valid.

The electrons are formed at the photocathode surface with low energy ($\approx 1$ ev) so that they thermalize quickly before moving a significant distance. This is very important because the probability of attachment to a neutral species decreases rapidly as the electron energy increases. In the absence of diffusion and a collection field, E, these electrons would accumulate in a thin sheet. During this time, the electrons attach to heavy neutrals if this is possible. When the field E is applied, the electrons and ions quickly gain their characteristic velocity $v_e$ and $v_i$ (for electron and ion) with $v_e >> v_i$. The resulting current wave form contains two pulses (if only one negative ion is formed), superimposed on a plateau current corresponding to the rate of electron ejection from the photocathode, which, with the above-mentioned modulated light source, is zero. If there are several negative ions, each will have a characteristic velocity and produce a characteristic pulse in the current wave form. This can be used to separate several species of neutrals from which the negative ions were formed.

Although the electrons do diffuse rapidly and invalidate this analysis, the anticipated results will still occur when the heavy negative ions are concentrated into a thin sheet when they are neutralized at the collection electrode. Hence, the analysis will continue neglecting electron diffusion, the effects of diffusion will be introduced later in the analysis.

FIGS. 3*a* through 3*c* show another embodiment of the present invention. FIG. 3*a* depicts only the central gas passageway as shown in FIG. 2 indicating the presence of a radiating plasma but not the outer wall confining the plasma or the means for electrically maintaining the plasma. The electrodes 41, 42, and 50 are within the cylindrical $MgF_2$ window 47 and are porous, such as a grid, so that the gas sample can pass through them as it flows through the gas passageway. One electrode, 41, has its voltage determined by generator 43 and the current flowing in grid 42 is measured as it flows through the input resistor 44 of a signal amplifier. Electrode 50 is connected to ground and is required if the arrival of a charge sheet is to be detected.

FIG. 3*b* shows an idealized signal derived from the current flowing in resistor 44, the status of the discharge, and the potential of electrode 41 as a function of time. Three signals are shown separately whereas the actual signal would be the sum of the three. One signal is due to electrons and occurs for the shortest time interval. Another signal is rectangular and results from the motion of heavy ions originally distributed between the electrodes.

FIG. 3*c* shows an electrode configuration required to actually obtain the idealized signal form as shown in FIG. 3*b* when the diffusion of the ions is taken into account. It consists of an assembly as shown which is inserted into the gas passageway shown in FIG. 3*a* in place of electrodes 41 and 42. This assembly consists of three porous electrodes 61, 62 and 63, and a fine wire electrode 64 separated and isolated from one another by windows 55, 56, 57 and 58 which are attached together by a sealing material which also supports the electrodes. This composite is sealed to the glass exit channel, 65. Electrode 61 is connected to generator 54, electrode 62 is connected to resistor 53, electrode 63 is connected to generator 52, and electrode 64 is connected to ground 51 via leads 59 through plug 66.

To better understand the operation of the detector in the electron capture mode, it is helpful to discuss the current wave form when the electrode not connected to the current measuring electrode (electrode 41 in FIG. 3*a*) is pulsed positive and then negative. FIG. 3*b* shows the current vs time under these circumstances for planar electrodes, both of which are illuminated by radiation capable of ejecting electrons from their surfaces and capable of ionizing a constituent of the gas between them. Diffusion effects are neglected.

It is desirable to apply a collecting field, E, only when the ionizing radiation is absent, because this eliminates constant standing currents due to electron production at the surface and in the volume. Hence, the system is illuminated for a time $\tau_1$, during which E=o and ions and electrons are not collected but accumulate, and then, during a time $\tau_2$, a field is applied, but the ionizing radiation is turned off.

When electrode 41 is pulsed positive, after the system has been accumulating ions and electrons for a period of time $\tau_1$, the uniformly distributed ions and electrons from volume photoionization are collected to give a short triangular electron pulse and a much longer heavy ion pulse which decreases linearly with time (see "New Method for Measuring the Rates of Ionic Transport and Loss. I. Mobility of NO+", R. A. Young, C. R. Gatz, R. L. Sharpless, C. M. Ablow; The Phys. Rev. Vol. 138, pp. A359–A370, 1965). The surface electrons give a sharper and larger pulse at field turn on. The heavy negative ions near electrode 41 are merged into this pulse because they have only a very short distance to travel. The negative ions from electrode 42 are collected at electrode 41 much later and cause an induced current in signal electrode 42 since the change in the field at its surface, $\Delta E=\Delta x(ne)/\epsilon_o$, causes a change in the induced surface charge.

When electrode 41 is made negative, the wave form is identical, although ion velocities and currents are reversed.

If the light source had not been turned off, there would be a large steady photoelectron surface current and a smaller volume photoionization current superimposed on these curves. The electron current would be large compared to the transient heavy ion currents and contribute greatly to the noise in the measurements as well as to offsets of significant magnitude.

By properly sampling these current wave forms, the contribution from volume (photoionization) and surface (electron attachment) charges can be separated. Obviously, one measures the volume signal after the early electron pulse and before the later negative ion pulse, and measures the negative ion pulse as the electron capture signal. In theory, these signals essentially do not overlap. This can be done in several ways.

It is advantageous to gate the current detector "on" only during the period when the transients due to turning on and off the ionization photon source and turning on the collecting electron field are not present. During this measuring interval, $\tau_3$, the positive ion signal can be separated from the negative ion signal, either in time or frequency.

The time scales in this analysis are determined by the gas velocity, $\tau_g$, through the detector and the electrode spacing, d, giving $\tau_d = d/\nu_g$, the gas transit time. The ion accumulation time, $\tau_1$, must satisfy $\tau_1 >> \tau_d$ if the surface ions are to remain as a thin sheet and so produce a sharp pulse when collected. The ion collection time $d/\Delta E = \tau_c$ must satisfy $\tau_c = \tau_2 < \tau_1$, or sensitivity is lost because the ions are generated only during a small fraction of the available time. Finally, $\tau_1 + \tau_2 < \tau_p$ where $\tau_p$ is the time width of the chromatogram peak being measured to insure that it is well resolved from other peaks by the current measurements.

A representative gas velocity for capillary (or chromatograph) columns is 10 cm $s^{-1}$ and an electrode spacing of 1 mm gives $\tau = 10$ ms which would be adequate. For average ion mobilities of $\approx 1$ (cm $^{s}-1$) ($\sqrt{}^{-1}$ cm) at atmospheric pressure, an electric field of 100 volts/cm would give $\nu_1 = 100$ cm/sec and an ion collection time of $\approx 1$ ms and an applied potential difference between electrodes of 10 volts, all of which are practical values. Both the photoionizing light source and electric fields can be switched in a few $\mu$s. The negative ion pulse would be 0.1 ms wide. The time for a cycle of measurement is 2 ms giving a measuring frequency of 500 Hz, a quite convenient value.

An embodiment of this electrode structure, as illustrated in FIG. 3c, turns out to be easier than might be expected. The electrode spacers (55, 56, 57) are composed of 4 mm O.D., by 1 mm thick $MgF_2$ washers with the central hole the diameter of the capillary column ($\approx$0.2 mm or larger). Between the washers fine mesh electrodes 51, 52, 53 are sandwiched. Several repetitive units may be employed, but we will presently consider only two spacers and three electrodes (for mobility measurements). These elements are held together by a high temperature sealing compound (not shown). The individual electrodes are connected by fine leads, 59, on the outside of the washer assembly which terminate in an electrical plug assembly (not shown). The electrode assembly 60, is transparent to the UV radiation emitted by the radiating plasma (1001 of FIG. 2) which surrounds the region (1011 of FIG. 2) in which the electrodes are placed and separated from this region by a cylindrical $MgF_2$ window (1012 of FIG. 2).

The entire unit is inserted into the photoionization cavity from the downstream of the photoionizer. Different detector assemblies can easily be exchanged and each easily cleaned or repaired.

With this arrangement, it is convenient to pulse the even numbered electrodes and measure ion currents on odd numbered electrodes. Of special significance in this design is electrode 53, the signal electrode. The ion velocities in alternate elements will be opposite to the gas velocity and so the wave forms in altered elements will be slightly displaced by this velocity. This displacement could be used to measure $\nu g$.

With a photoelectron emission of $10^{14}$ electron $s^{-1}cm^{-2}$ (10$\mu$amp $cm^{-2}$), computed using a measured radiance of the Kr (10 ev) light source of $5 \times 10^{15}$ photons $s^{-1}sr^{-1}cm^{-2}$ and a 2% quantum yield, and stream velocity of 10 cm $s^{-1}$, the electron density has a steady state value of $10^{13}$ electrons $cm^{-3}$. Since there is a negligible concentration of positive ions, the major electron loss is by diffusion, which will be subsequently discussed, and not by recombination as is usually the case. The effective two-body attachment rate coefficient is $\approx 10^{-9} cm^3 s^{-1}$ so the mean time for attachment is 100$\mu$sec. This is short relative to all other time constants and implies that all of the neutral species which can form negative ions do so during the field free charge accumulation period and none are lost by ion-ion recombination.

Unfortunately, electrons have a diffusion coefficient, $D \approx 10 cm^2 s^{-1}$ at atmospheric pressure. Then they will diffuse a mean distance $\langle x \rangle = \sqrt{2D\tau}$, or $\approx 1$ mm in 1 ms. This means that instead of forming a 0.1 mm thick sheet, they more or less uniformly fill the 1 mm long electrode cell. Because of this, the negative ions will be formed throughout the cell and will not produce a sharp pulse as we have imagined and the electron density would be $\approx 1/10$ that previously calculated, i.e. $= 10^{12} cm^{-3}$, and the attachment time $= 1000$ $\mu$s is now comparable to the ion accumulation period.

However, consider the two cells and three electrodes, 60, as an integral unit. When the middle electrode is positive, it collects negative ions from both cells and neutralizes them at the electrode. Hence, concentrated on the attaching species in both cells is $\sqrt{}$ at the surface of the middle electrode. If the preceding ion accumulation period is 20 ms, the electron density will rise to greater than $10^{12} cm^{-3}$ and the time for electron attachment will be sufficiently short that all attachable species are converted to negative ions. Because the negative ions neutralize at the electrode re-attach to form negative ions in $<1$ ms, the neutrals can never move more than 0.1 mm from the electrode because of the stream velocity of 10 cm $s^{-1}$.

On its next measuring cycle, the middle electrode becomes negative. Since the gas has moved 0.1 mm downstream during the proceeding 1 ms accumulation period, when again all the concentrated species form negative ions because of the large electron density near the electrode, and since these heavy ions diffuse only $=0.1$ mm in the 1 ms accumulation time, and no negative ions have been formed elsewhere in the second cell (because these species were concentrated near the middle electrode), the negative ions will produce a sharp current peak as previously expected (in the absence of electron diffusion), but 20 times bigger, because all the negative ions producible in a 2 mm segment of gas have been concentrated.

Hence, one should alternate accumulation periods of 20 ms with periods of 1 ms, thus increasing the magnitude of the sharp pulse during measurement after the short accumulation period in the second detector cell while replacing the gas which was previously depleted of attaching species. The negative ion signal following the 20 ms period is identical to the photoionization signal because the ions are uniformly distributed. This signal, of course, has its uses. However, at the end of the first collection period, the parents of the negative ions from a 2 mm length of gas have been concentrated in a 0.1 mm length of gas by the ion collection and neutralization process. The attaching species do not migrate with the gas stream because they continually re-attach after neutralization at the electrode and so remain within a distance equal to the stream velocity multiplied by the attaching time. Hence, in the subsequent attachment period, these are all again converted to negative ions in the next stream cell of the detector and form a 0.1 mm sheet with a density $\approx 20$ times that which would have resulted from attachment in 0.1 mm length of gas in the absence of concentration.

Since each sharp, heavy negative ion pulse is composed of all species which can attach electrons in a 2 mm thick column of gas, the sensitivity of the device is simply calculated from the electrometer noise. Presuming this is shot noise limited, the noise is $f^{\frac{1}{2}}N^{\frac{1}{2}}$ where N is the total number of ions collected, and f is the required frequency band width. Presuming the column area is $\approx 1\text{mm}^2 = 10^{-2}\text{cm}^2$ then the volume is $2\times 10^{-3}\text{cm}^3$ because 2 mm of length is measured. For a species density of $n(\text{cm}^{-3})$ we find $N = 2n\times 10^{-3}$ so the shot noise is $10^2(2n\times 10^{-3})^{\frac{1}{2}}$ for a pulse width of 0.1 ms or $f = 10^4$ Hz. For a signal to noise of $10 = N/10^2(N^{\frac{1}{2}}) = N^{\frac{1}{2}}10^2$ we find that $N = 10^6$ or a peak current of $10^{-10}$ amps, a charge density of $5\times 10^8\text{cm}^{-3}$ and $n = 5\times 10^8$ molecules $\text{cm}^{-3}$ or $10^{-11}$ of the carrier gas. Even with a cross section area of 0.1 mm, 1 part per billion can be detected. This is a phenonmenal sensitivity.

This superior performance results from the novel detector which is based on patented RF maintained plasma ultraviolet emission technology in a configuration which surrounds a tubular sample passageway where both measuring electrodes and non-reactive photocathodes are located. The very efficient and bright light source which is optimally coupled to the measuring region can be rapidly ($\approx 3$ μs) switched on or off and so permits ions and electrons to be generated, but measured without standing currents. These standing currents presently limit measurements, because of their large contribution to noise and off-set. Even in this mode of operation, when it would only require constant potentials on the electrodes, photoelectron standing currents have 1/10 the noise of radioactive decay produced standing currents which are now the standard.

By gating the ionizing light source asymmetrically with a long ($\approx 20$ ms), and then a short ($\approx 1$ ms) ionizing period, interspersed with $\approx 1$ ms ion collection periods, the negative ions formed in a long ($\approx 2.0$ mm) column which, when collected, produce a short ($\approx 0.1$ ms), large current pulse which is easily distinguished from the much longer ($\approx 1$ ms) current pulse which could be formed from positive ions produced throughout the ionization region by volume photoionization.

Electron diffusion can spread the electrons throughout the measuring cell, but collision of the electrons as they leave the photocathode may return them to the electrode and decrease the photoelectron yield. Since the electrode potential is unspecified during the accumulation period, it can now be adjusted to maximize the photoelectron yield. The required applied potential will probably be less than 1 volt.

Since recombination of positive ions with electrons has a rate coefficient of $10^{-7}\text{cm}^{-3}\text{s}^{-1}$, it is clear that any positive ions formed by volume photoionization will be neutralized during accumulation and before collection unless the electron density is reduced below $10^9\text{cm}^{-3}$ (so the positive ions have a lifetime of $\approx 10$ ms). Indeed this phenomena produces the charge in the standing electron current when this device is operated in the standard electron attachment detector mode.

This means that a third cell, 2 mm long, must be added with electrodes that suppress photoelectrons if the device is to be used on both an electron capture detector and/or a photoionization detector. If one electrode is a photocathode, diffusion will transport electrons even against a field induced velocity a distance determined from $\langle x\rangle = \sqrt{2D\tau} = v_e\tau = d$ or $2D\tau = v^2\tau^2$ or $2D/v = v_e\tau = d$. For $d < 0.1$ mm then $2D/v < 10^{-2}$ since $D \approx 10$ this mean that $v_e 10^3$ of a field of 1 volts/cm, which is roughly 1/100 that used for ion collection. Hence, to prevent significant penetration of photoelectrons from the electrodes into the photoionization region a counter-field of $v\text{cm}^{-1}$ is required. This corresponds to an applied potential of 0.2 volts.

The easiest way to reduce photoelectrons is to reduce the area of the photocathode from which they are removed (only the negative electrode). Hence, a "needle" or tone wire electrode 2 mm downstream from the third mesh electrode, held at −0.2 volts during the accumulation period to prevent diffusion of electrons from the third grid and changed to −20 volts during the second collection period, will produce the expected positive ion wave form at the third mesh (signal) electrode. This will be added to the distributed negative ion signal during the measuring period following the 20 ms accumulation period, but will be the only long pulse during the second measuring period.

When the ion or electron densities become large enough, they significantly perturb the applied electric field and hence effect ion and electron motion. The change in electric field ΔE that occur in penetrating a uniform ion density, n, a distance Δx is, in MKS units, $\Delta E = ne\Delta x/\epsilon o = 1.8\times 10^{-8}n\Delta x$. Hence, for electron densities $\approx 10^{13}\text{cm}^{-3}$ and $\Delta x \approx 0.1$cm, $\Delta E \approx 2\times 10^4$ volts $\text{cm}^{-1}$ which is much larger than that applied ($\approx 100$ volts $\text{cm}^{-1}$). This means that the rate at which electrons are collected is determined by the rate at which the field penetrates the charge distribution, which is determined by the rate of charge removal where the field is finite. Because the mobility of the electrons is very large, the electrons are still removed very quickly relative to other time intervals ($\approx 1$ ms) involved in the analysis (see Young, et al).

However, for heavy ions, which are collected in 1ms under the anticipated conditions, any significant perturbation of the applied field would be observable. At the minimum sensitivity just collected, the negative ion sheath has a density of $5\times 10^8\text{cm}^{-3}$ and is $\approx 10^{31}$ $^2$cm thick. Hence, the charge in electric field between its surfaces is $\Delta E = (1.8\times 10^{-8})(5\times 10^8)(10^{-2}) = 9\times 10^{-2}$ volts $\text{cm}^{-1}$ which is $\approx 10^{-3}$ of the applied field and negligible.

For significantly higher concentrations of attachable species this "space charge" effect will become significant, and broaden the current pulse produced by this collection. However, by increasing the applied field, and hence, decreasing the ion transient time, and increasing the shot noise (but not as fast as the signal increases because of the presumed increase in attachable species concentration) these effects can again be made negligible.

The negative ion signal following the 20 ms accumulation pulse, in which the ions are uniformly distributed in space, is analyzable even when space charge is dominant (see R. A. Young, et al) in a simple way to give both ion densities and mobilities. Hence, at large concentrations of attachable species, the first measuring pulse can be used to obtain species concentration measurements, while the second measuring interval indicates if negative ions predominate over positive ions.

As we have seen, essentially all electron attaching species form negative ions. However, only a small fraction of the photoionizable species are ionized. Hence, the photoionization detector is less sensitive than the electron capture detector and positive ions will interfere in the measurement of negative ions during the first measuring period only when the species they are derived from greatly exceeds the species from which the negative ions are derived.

It needs to be clearly understood that the photoionizer which produces the very large and essentially isotropic ionizing photon flux is described in U.S. Pat. No. 4,377,749, filed Feb. 25, 1981 and is an existing device on which measurements have supported the photon fluxes used in these calculations. This device has been used as a photoionization gas chromatograph detector.

Measurements have shown that this source will produce electron fluxes from dirty non-reactive metal surfaces, and even oxidized aluminum surfaces, of the size used in these calculations.

I claim:

1. An ionization source for a mass spectrometer comprising a substantially cylindrical lamp;

an RF oscillator coil adjacent the outer wall of said lamp;

a passageway through said lamp;

a substantially cylindrical window in the wall of said passageway, said window being transparent to VUV ionizing radiation;

a substantially circular electron acceleration grid in said passageway having a length substantially the same as said window;

a substantially cylindrical high work function photocathode between said window and said grid, said acceleration grid being at a positive potential relative to said photocathode;

a gas filling between the wall of said lamp and said wall of said passageway for generating optical photons when said RF oscillator is energized;

means for passing a sample gas through said passageway, whereby said photons passing through said window illuminate said photocathode to cause ejection of electrons into said passageway, said electrons ionizing said sample gas by electron impact after being accelerated by said grid; and means for focusing said ions into said mass spectrometer.

2. The ionization source of claim 1 wherein said means for focusing said ions comprises substantially circular ion drawout lenses in said passageway on either side of said acceleration grid.

3. The ionization source of claim wherein the wall of said lamp is of a bellows configuration.

4. The ionization source of claim 1 wherein said photocathode is a grid.

5. The ionization source of claim 1 wherein said photocathode is a mesh.

6. The ionization source of claim 1 wherein said photocathode is of a thickness which permits electrons to be emitted from the side opposite said window.

7. An ionization source for mass spectrometers comprising an ionization light source;

means to power and excite said ionization light source;

means to connect said excitation means to said light source;

means to inject a fluid sample past said ionization light source;

means to photoelectrically generate electrons by said ionization light source;

means to accelerate said photoelectrons;

means to extract heavy ions generated by said accelerated photoelectrons from said fluid sample; and means to focus the extracted heavy ions into a mass spectrometer.

8. The ionization light source of claim 7 wherein said means to power and excite the light source is an RF electromagnetic field.

9. The ionization source of claim 8 wherein said RF electromagnetic field is established by a driven series resonance circuit.

10. The ionization source of claim 8 wherein the RF field is in the frequency range 50 to 250 MHz.

11. The ionization source of claim 9 wherein said driven series resonance circuit has its inductance coil substantially wound around said ionization light source so as to concentrate the discharge about a transparent portion of its central sample passageway.

12. The ionization source of claim 9 wherein said resonance circuit includes an inductance which constitutes a support of said ionization light source.

13. The ionization light source of claim 7 wherein said connecting means between said ionization light source and said exciter comprises a coil.

14. The ionization light source of claim 7 wherein said fluid injection means comprises an aperture in mass transfer relationship to said light source.

15. The ionization source of claim 7 wherein said means to generate photoelectrons is a photocathode.

16. The ionization source of claim 15 wherein said photocathode is located in said sample passageway adjacent to said ionization light source.

17. The ionization source of claim 16 wherein said photocathode is substantially adjacent the surface of the VUV transparent section of the sample passageway.

18. The ionization source of claim 16 wherein said photocathode is a nonreactive conducting material.

19. The ionization source of claim 15 wherein said photocathode is semi-transparent to the ionizing radiation.

20. The ionization source of claim 19 wherein said photocathode is a thin deposit of material.

21. The ionization source of claim 19 wherein said photocathode comprises a sheet with holes in it.

22. The ionization source of claim 19 wherein said photocathode comprises a mesh.

23. The ionization source of claim 7 wherein said electron accelerating means comprises an electric field.

24. The ionization source of claim 23 wherein said electric field is generated by conducting electrodes.

25. The ionization source of claim 24 wherein said conducting electrodes are semi-transparent to both electrons and VUV radiation.

26. The ionization source of claim 25 wherein said conducting electrodes comprise a conducting sheet with holes in it.

27. The ionization source of claim 25 wherein said conducting electrodes comprise a mesh.

28. The ionization source of claim 25 wherein said conducting electrodes are a fixed distance from said photocathode.

29. The ionization source of claim 28 wherein said conducting electrodes comprise a cylinder.

30. The ionization source of claim 7 wherein said heavy ion extractor means comprises an electric field.

31. The ionization source of claim 30 wherein said electric field is generated by conducting electrodes.

32. The ionization source of claim 30 wherein said electrodes are located near the VUV transparent portion of said sample passageway.

* * * * *